United States Patent [19]

Arrao et al.

[11] Patent Number: 4,936,749

[45] Date of Patent: Jun. 26, 1990

[54] BLADE-TO-BLADE VIBRATION DAMPER

[75] Inventors: Anthony S. Arrao, Belmont; John G. Nourse, Topsfield, both of Mass.

[73] Assignee: General Electric Company, Lynn, Mass.

[21] Appl. No.: 287,232

[22] Filed: Dec. 21, 1988

[51] Int. Cl.[5] ..... F01D 5/18; F01D 5/24

[52] U.S. Cl. ..... 416/193 A; 416/190; 416/500

[58] Field of Search ..... 416/190, 191, 193 A, 416/500

[56] References Cited

U.S. PATENT DOCUMENTS

| | | | |
|---|---|---|---|
| Re. 32,339 | 1/1987 | Jones et al. | 416/190 |
| 1,378,464 | 5/1921 | Junggren . | |
| 1,554,614 | 9/1925 | Allen | 416/193 A |
| 2,310,412 | 2/1943 | Flanders | 416/190 |
| 2,942,843 | 6/1960 | Sampson | 416/190 |
| 3,037,741 | 6/1962 | Tuft . | |
| 3,245,657 | 4/1966 | Cooper et al. | 416/193 A |
| 3,266,771 | 8/1966 | Morley . | |
| 3,295,825 | 6/1967 | Hall | 416/193 A |
| 3,709,631 | 1/1973 | Karstensen et al. | 416/193 A |
| 3,728,041 | 4/1973 | Bertelson | 416/193 A |
| 3,752,598 | 8/1973 | Bowers et al. | 416/191 |
| 3,834,831 | 9/1974 | Mitchell | 416/193 A |
| 3,918,842 | 11/1975 | Longley et al. | 416/193 A |
| 4,182,598 | 1/1980 | Nelson | 416/193 A |
| 4,183,720 | 1/1980 | Brantley | 416/193 A |
| 4,455,122 | 6/1984 | Schwarzmann et al. | 416/190 |
| 4,457,668 | 7/1984 | Hallinger | 416/95 |
| 4,494,909 | 1/1985 | Forestier | 416/190 |
| 4,497,611 | 2/1985 | Keller | 415/191 |
| 4,505,642 | 3/1985 | Hill | 416/193 |
| 4,516,910 | 5/1985 | Bouiller et al. | 416/190 |
| 4,536,129 | 8/1985 | Jankot | 416/95 |
| 4,568,247 | 2/1986 | Jones et al. | 416/190 |
| 4,621,976 | 11/1986 | Marshall et al. | 415/191 |

FOREIGN PATENT DOCUMENTS

| | | | |
|---|---|---|---|
| 8412 | 1/1986 | Japan | 416/193 A |
| 342795 | 1/1960 | Switzerland | 416/193 A |
| 875412 | 8/1961 | United Kingdom | 416/193 A |

*Primary Examiner*—Everette A. Powell, Jr.

*Attorney, Agent, or Firm*—Francis L. Conte; Jerome C. Squillaro

[57] ABSTRACT

A blade-to-blade vibration damper for a turbine rotor blade is disclosed. Each blade has airfoil, platform and root portions. A plurality of blades are circumferentially spaced about a rotor disk. An inclined recess extends into the platform portion of each blade from a first surface thereof, and toward its root portion. A U-shaped wire-form damping member has its in-turned marginal end portions slidably received in each recess. When the rotor disk is rotated at a sufficient angular speed, the damping members move outwardly by the centrifugal force acting thereon to engage the opposing surface of the platform portion of the adjacent blade. When so engaged, the members damp vibrations of such blades and seal the space between the opposing platform surfaces.

20 Claims, 2 Drawing Sheets

BLADE-TO-BLADE VIBRATION DAMPER

This invention was made with Government support under contract DAAE07-84-C-R083 awarded by the Department of the Army. The Government has certain rights in the invention.

BACKGROUND OF THE INVENTION

The present invention relates generally to turbines and compressors, and, more specifically, to an improved mechanism for damping vibrations and sealing the spaces between the adjacent platform portions of a row of circumferentially spaced blades in a gas turbine engine.

Gas turbine engines typically have a plurality of rows of circumferentially spaced rotor blades mounted on a disk for rotation therewith about the disk axis. These blades exist in a myriad of different shapes and configurations, but generally have an innermost root portion, an intermediate platform portion and an outermost airfoil portion. The root portion, also known as a dovetail, commonly has an inverted "fir tree"-like shape or appearance, and is slidably received in a complimentarily configured recess provided in the rotor disk. The platform portions separate the root and airfoil portions of the blades, and collectively define an outwardly facing wall of an annular gas flow passageway through the engine. The airfoil portions typically extend radially into the passageway to interact with the gas flow therethrough. At the same time, however, these airfoil portions constitute cantilevered members which are subject to fatigue due to vibrations. This problem is particularly acute since the disk may be rotated at angular speeds ranging from zero to 45,000 r.p.m. and beyond.

The source and nature of such blade vibrations are difficult to understand, identify and eliminate. Such vibrations may, in fact, be functions of many variables, some controllable and others not. In any event, there is a general need and desire to damp such vibrations to reduce the fatigue on the blades, particularly at or near resonant frequencies. At the same time, there is also a need to effectively seal the space between the platform portions of adjacent blades to confine the gas flow to the annular passageway.

Various types of blade dampers are known. For example, in a shroud-type damper, the distal ends of adjacent airfoil portions are physically connected to one another. While this design places a blade-to-blade connecting member at the greatest radial distance from the rotor disk axis, and may indeed constitute an effective damper, it increases the mass of the airfoil portions, does not contribute to sealing of the space between adjacent platform portions, and may interfere with the gas flow through the passageway.

Under-platform dampers are also known. These devices generally have a movable member operatively positioned between the rotor disk and the underside of the platform portion(s) of one or more blades. Upon rotation of the turbine, this member is adapted to be centrifugally forced radially outwardly into fluid-tight sealed engagement with the underside surfaces of adjacent blades. While these arrangements may provide an effective seal between the adjacent platform portions, and may provide an effective vibration damper in some applications, the points of contact between the member and the blade(s) are typically located on the underside of the platform portions.

Summary of the Invention

Accordingly, one object of the present invention is to provide an new and improved vibration damper, which is particularly adopted for use in a gas turbine engine.

Another object of the present invention is to provide a new and improved blade-to-blade vibration damper for a gas turbine engine, which also provides an effective seal between the platform portions of adjacent blades.

Another object of the present invention is to provide an improved blade-to-blade vibration damper and sealing member which is inexpensive to manufacture, easy to assemble, and which does not require special machining of the rotor disk.

An improved rotor blade is disclosed. The improved blade is adapted to be mounted on a rotor disk in circumferentially spaced relation to an adjacent blade. The improved blade includes airfoil, platform and root portions. The platform portion has a first surface arranged in spaced facing relation to an opposing surface of an adjacent blade. The improved blade has one or more inclined recesses extending into its platform portion from the first surface and toward its root portion, and has a member operatively arranged in this recess for sliding movement relative thereto. The member is so configured and arranged with respect to the recess that when the rotor disk is caused to rotate at a sufficient angular speed, the centrifugal force acting on the member will urge the member to move outwardly along a path defined by the recess to engage the adjacent blade opposing surface to damp vibrations of at least one of the blades. In a preferred embodiment, the damping member also substantially seals the space between the first and opposing surfaces when the rotor is at speed.

Brief Description of the Drawings

The novel features believed characteristic of the invention are set forth in the claims. The invention, in accordance with preferred embodiments, together with further objects and advantages thereof, is more particularly described in the following detailed description taken in conjunction with the accompanying drawing, in which:

Detailed Description

Figure 1:
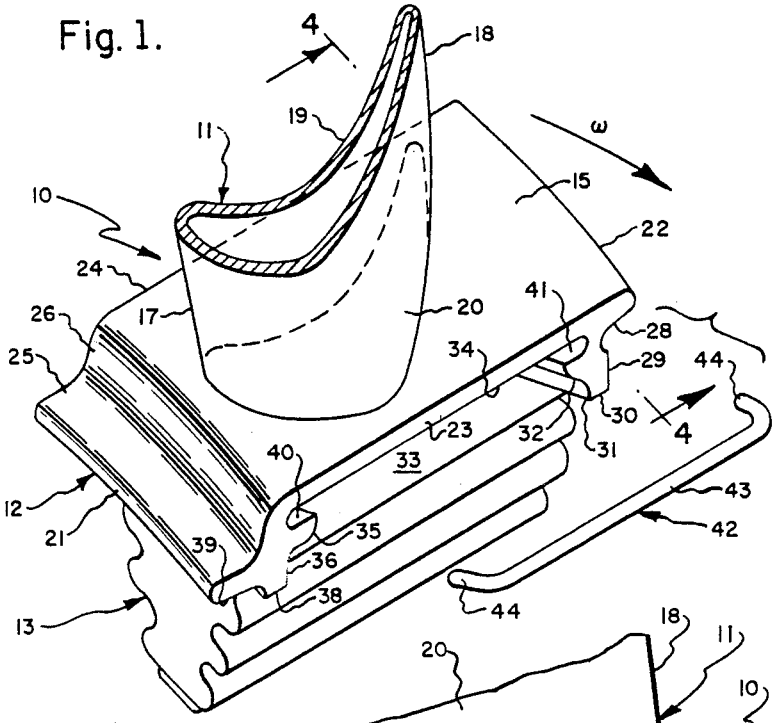
FIG. 1 is a perspective view of a preferred form of an improved rotor blade in accordance with one embodiment of the invention, showing airfoil, platform and root portions thereof, and showing a U-shaped member in exploded aligned relation to an inclined recess which extends into the platform portion from its leading surface.

Referring initially to FIG. 1, an improved rotor blade in accordance with a preferred embodiment of the invention is generally indicated at 10. This blade is broadly shown as having an upper airfoil portion 11, and intermediate platform portion 12, and a lower root or dovetail portion 13.

Figure 4:
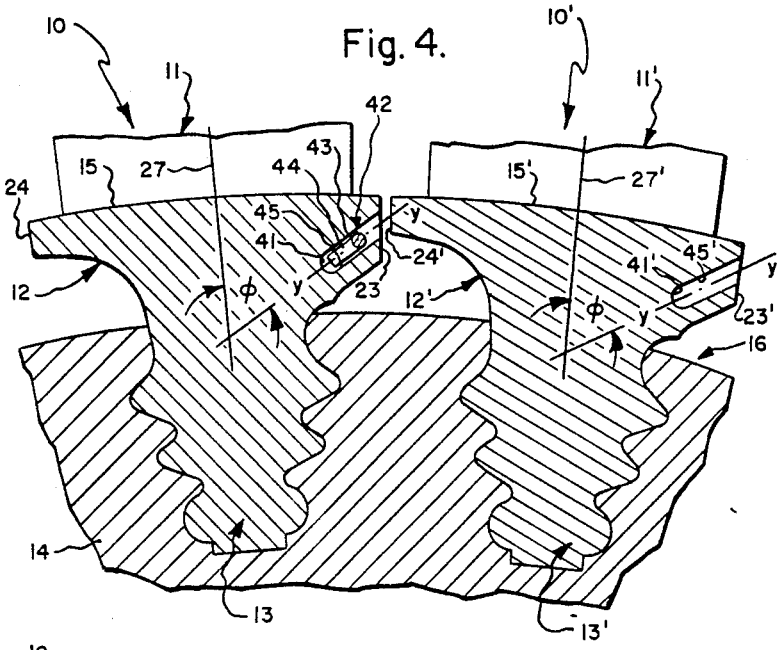
FIG. 4 is a schematic view showing two adjacent blades as being mounted on a rotor disk, and showing the member of the left blade as being arranged deep within the recess, as when the rotor is at rest.
Figure 5:
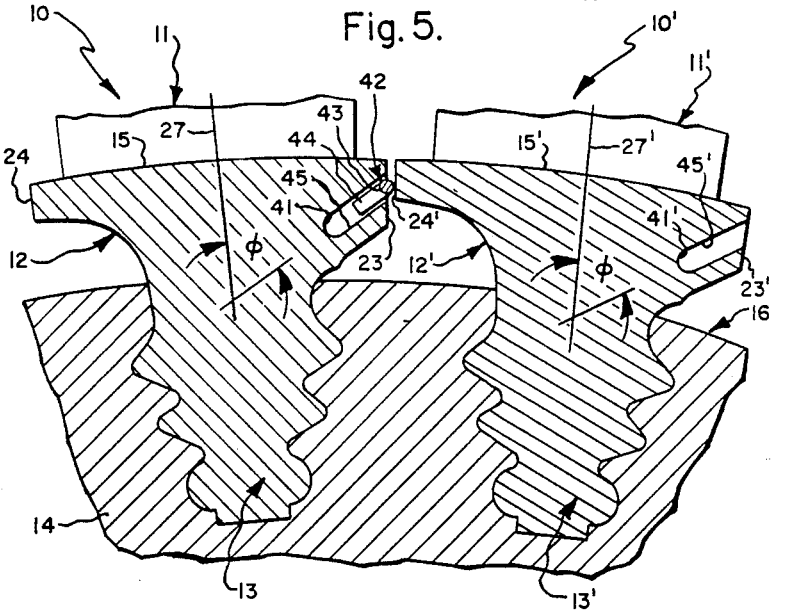
FIG. 5 is a view generally similar to FIG. 4, but showing the damping member as having moved centrifugally outwardly along the inclined recess to engage the trailing surface of the adjacent blade when the rotor disk is rotated at a sufficient angular speed.

Persons skilled in this art will readily appreciate that a plurality of such rotor blades are adapted to be operatively mounted on a rotor disk, of which a fragmentary portion is generally indicated at 14 in FIGS. 4 and 5, in circumferentially spaced relation. The airfoil portions of such blades are adapted to extend radially outwardly into an annular flow passageway (not shown) defined between outwardly facing cylindrically segmented surfaces 15 of the platform portions and an inwardly facing surface (not shown) of a shroud. The rotor is journalled for rotation about a horizontal axial axis (not shown) such that the airfoil portions will be rotated in this annular flow passageway. In the illustrated embodiment of the invention applied in a turbine, the blades 10 rotate in the direction of the arrow in response to a flow of gas through the passageway. The rotating disk-and-blade turbine assembly, generally indicated at 16 in FIGS. 4 and 5, thus extracts energy from the flow, which is converted to rotation of the rotor assembly.

The airfoil portion has an upstanding forwardly facing rounded leading edge 17 directed toward the gas flow, an aft facing trailing edge 18, a concave pressure surface 19, and a convex suction surface 20 on the reverse side of the airfoil portion. The airfoil portion is shown as being hollow to accommodate a flow of cooling gas therethrough. It should be clearly understood, however, that the particular shape or configuration of the airfoil portion is not deemed to be critical to a fundamental understanding of the improved blade, and may be readily changed or modified.

The root portion 13 is shown as having a conventional inverted "fir tree" shape or appearance, and is adapted to be slidably inserted into a complimentarily configured axially disposed recess provided in the rotor disk. Here again, the root portion, and its operative connection with the rotor disk, is shown schematically in FIGS. 4 and 5, and may be readily changed or modified.

Figure 2:
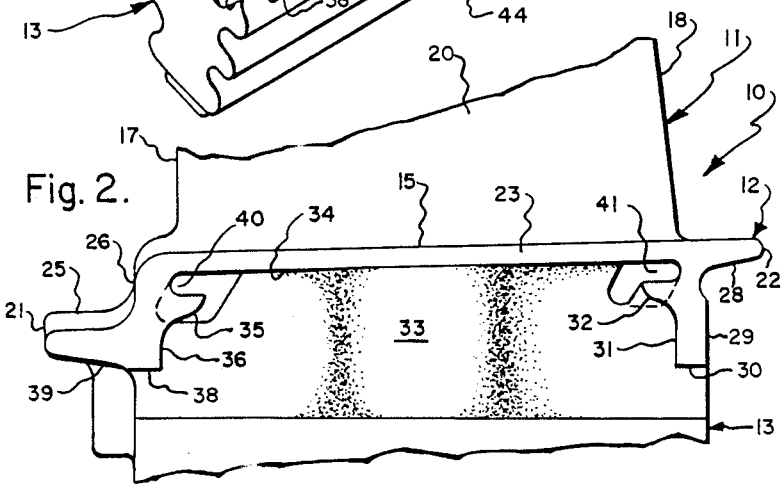
FIG. 2 is a fragmentary enlarged elevational view of a leading surface of the platform portion, showing the member-receiving inclined recess.

The platform portion will now be described in greater detail. As best shown in FIGS. 1 and 2, the platform portion has a substantially rectangular outline or appearance, when viewed in top plan, and is bounded by arcuate rounded forward and aft surfaces 21,22, and by radially extending leading and trailing side surfaces 23,24, respectively. The entire blade is preferably an integrally formed cast-and-machined member. Hence, the airfoil portion extends radially outwardly from platform portion upper surface 15 as a cantilevered member. Persons skilled in this art will also appreciate that when exposed to a gas flow, this airfoil portion will be subjected to both flexural and torsional stresses.

When viewed in side elevation (FIG. 2), the platform portion is seen as having an upwardly facing slightly rounded cylindrically segmented surface 25, a forwardly facing segmented annular surface 26, the outwardly facing slightly rounded cylindrically segmented surface 15 joining aft surface 22, a downwardly facing slightly rounded cylindrically segmented surface 28 extending forwardly from aft surface 22, an aft facing annular segmented surface 29, an inwardly facing surface 30, a forwardly facing surface 31, an arcuate surface 32 extending upwardly and forwardly therefrom, an arcuate side surface 33 rising upwardly from the root portion to join a lower edge 34 of leading surface 23, an arcuate surface 35, an aft facing surface 36, an inwardly facing surface 38, and a downwardly and forwardly facing cylindrically segmented surface 39 continuing forwardly therefrom to join the lower margin of forward surface 21. All surfaces of revolution just described are generated about the axis of the rotor disk.

Two transversely spaced facing U-shaped slot-like recesses 40,41 are machined radially downwardly into the platform portion from its leading surface 23, to receive and accommodate slidable insertion of the damping member 42. Each of these slots is elongated along an axis y—y (FIGS. 4 and 5), which, in the preferred embodiment, is inclined with respect to leading surface 23 and a longitudinal or radial axis 27 of the blade 10 at an acute included angle $\phi$ of about 26°. This angle may be varied to accommodate different blade and damper configurations. In some cases, the angle may be as little as 10°–15°, while in others it may be on the order of 60°, all depending upon the minimum amount of damping necessary to reduce vibratory response of blade 10 to acceptable engine operating levels. The particular angle is determined empirically, analytically or both for each blade configuration for maximizing damping effectiveness, and is thought to be a function of the mass, configuration and dimensions of the airfoil portion, the rotation speed of the rotor, the frequency of the blade, the asps of the damping member, and friction, possibly inter alia.

Figure 3:
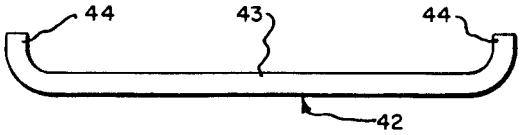
FIG. 3 is a plan view of the U-shaped member.

As best shown in FIG. 3, the damping member 42 may simply be a U-shaped bent-wire member, having a central rod-like portion 43 and two in-turned parallel marginal end portions, severally indicated at 44. These marginal end portions are adapted to be slidably inserted into the spaced fore and aft recesses 40,41, as shown in FIGS. 4 and 5, such that the member may slide freely within these recesses. Moreover, the mouth of each recess is adapted to be aligned with the opposed trailing surface of the adjacent blade, when such blades are mounted on the rotor disk. Hence, when the rotor disk is at rest, the damping member associated with each blade may move to a gravitationally stable position For example, the blades shown in FIG. 4 are depicted as being in the vicinity of the top dead center position of the rotor disk, with the left blade being indicated at 10 and the adjacent right blade being indicated at 10'. These two blades are structurally identical to one another, and the prime of the same reference numeral used to identify the left blade is again used to identify the corresponding part, portion or surface of the adjacent right blade. The only difference is that the damping member has been omitted from right blade 10' in order to show the aft recess 41' in cross-section. Hence, damping member 42 may slide down to the bottom of its associated recesses. On the other hand, the damping member of the diametrically opposite blade (not shown) will be free to side outwardly along its associated recess to engage the opposing trailing surface of its adjacent blade. This free sliding movement of the damping members relative to their associated recesses is facilitated by the fact that the damping members engage the recess walls substantially in line contact, as opposed to area contact. This minimizes the frictional forces which might otherwise impede free sliding movement of the damping members relative to their associated recesses.

FIG. 5 depicts the situation when the rotor is rotating at a sufficient angular speed, such that the centrifugal force acting on the relatively movable damping member urges it to move outwardly along the path defined by its associated recesses 40,41 to forcibly engage the opposing surface (i.e., the trailing surface 24') of the adjacent rightward blade 10'. Such centrifugal force will exert a radial force on the damping member. This radial force may be broken down into components parallel to, and perpendicular to, the slot axis y—y. The perpendicular component will urge the damping member to move outwardly against an inwardly facing recess outer wall 45. However, as previously noted, the marginal end portions of the damping member engage the slot wall substantially in line, as opposed to area, contact. Henee, this perpendicular force will not act over a large area. The parallel force component will urge the damping member to move outwardly along the recess so that its rod-like central portion 43 will forcibly engage the trailing surface 24' of the adjacent blade, as shown in FIG. 5. This damping member central portion is preferably substantially equal in length to the axial overlapped length of the facing leading and trailing surfaces, 23,24, respectively, so that the central portion will engage the adjacent blade opposing surface 24' in line contact and will substantially seal the space between such surfaces when the rotor disk is at speed. This axial length, which represents the portion of the surfaces 23,24 which face each other, should be as large as possible to seal as much as possible the axial space between adjacent platforms 12,12'. Of course, the diameter of the central portion 43 is greater than the spacing between the opposing surfaces 23,24' of the adjacent blades to insure an effective seal by providing a complete blockage of the circumferential space between the opposing surfaces 23,24.

One advantage of the improved damper arrangement over prior art under-platform dampers is that the improved damper forcibly engages the opposing side surface 24' of the adjacent blade, and at a location radially outwardly more distant from the points of contact of prior art under-platform dampers, which would have more reaction due to vibration, and, therefore, will be more effectively damped by the member 42. With this arrangement, effective damping can be achieved without unduly increasing the mass of the damping member. The blade-to-blade friction scrubbing action due to this forced engagement dampens the vibrations of at least one, and perhaps both, of the blades.

At the same time, the improved blade construction does not require any special dedicated machining of the rotor disk itself, for the recess is formed directly in the blade instead. Blade surface 33 is bowed outwardly in the center of its fore-and-aft dimension to accommodate a minimum wall thickness for internal cooling passages in the root portion of the blade. Hence, the damper cannot be assembled backwards because the free ends of the damper would protrude outwardly to not allow the adjacent blade to be assembled in the rotor disk. Moreover, the damper is removable with the associated blade. The materials of construction are not deemed critical, and may be readily selected depending upon the expected serviced conditions. Another advantage is that the damping member engages a thickened portion of the adjacent blade (i.e., platform 12 at the trailing surface 24), which reduces the fretting effect on the adjacent blade due to the scrubbing action therebetween. The wire-formed U-shaped damping member is inexpensive to manufacture, easy to install and remove, and, with the in-turned marginal end portions 44 retained in slots 40,41, cannot become angularly misaligned with respect to the opposing surface of the adjacent blade.

If desired, the recesses could extend into the blade from the trailing surface thereof, and the damping member, be it U-shaped or otherwise, could be arranged to move outwardly along a wall of such recess to engage the opposing leading surface of the adjacent blade. Whether the recesses extend into the blade from the leading or trailing surfaces thereof, is, therefore, largely a matter of the physical configuration of the blade, and manufacturing convenience. For example, in the embodiment illustrated, the recesses 40,41 are placed in the leading surfaces 23 to avoid or reduce undercutting of the airfoil 11 to reduce stress concentration.

While there have been described herein what are considered to be preferred embodiments of the present invention, other modifications of the invention shall be apparent to those skilled in the art from the teachings herein, and it is, therefore, desired to secure in the appended claims all such modifications as fall within the true spirit and scope of the invention.

Accordingly, what is desired to be secured by Letters Patent of the United States is the invention as defined and differentiated in the following claims.

We claim:

1. An improved rotor blade adapted to be mounted on a rotor disk in circumferentially spaced relation to an adjacent blade, said improved blade comprising:

an airfoil portion, a platform portion and a root portion, said platform portion having a first surface adapted to be arrange din spaced facing relation to an opposing surface of said adjacent rotor blade, said improved blade also having an arcuate surface extending between said root portion and said first surface, said arcuate surface being bowed outwardly in a transverse direction;

two transversely spaced inclined recess slots extending into said platform portion from said first surface and toward said root portion; and a U-shaped member having a rod-like central portion and in-turned marginal end portions, said marginal end portions being arranged in said slots for sliding movement relative thereto so that said central portion may move toward and away from said bowed arcuate surface along the path defined by said slots, said U-shaped member being adapted to be moved relative to said platform portion to a position at which no portion thereof will extend outwardly beyond said first surface toward said opposing surface, said member being so configured and arranged that when said rotor is caused to rotate at a sufficient angular speed, the centrifugal force acting on said member will urge said member to move outwardly along said path so that said central portion will engage said adjacent blade opposing surface to damp vibrations of at least one of said blades.

2. The improved rotor blade as set forth in claim 1 wherein said U-shaped member is size relative to said arcuate surface so that upon attempted insertion of said U-shaped member backwards into said slots, said end portions would protrude outwardly beyond said first surface toward said opposing surface.

3. The improved rotor blade as set forth in claim 1 wherein said member is formed of a length of wire.

4. The improved rotor blade as set forth in claim 2 wherein the diameter of said central portion is greater than the spacing between said improved blade first surface and said adjacent blade opposing surface.

5. The improved rotor blade as set forth in claim 2 wherein said central portion has an effective length substantially equal to an overlapped length of said improved blade first surface and said adjacent blade opposing surface.

6. The improved rotor blade as set forth in claim 1 wherein the axis of said recess is inclined at an acute included angle of about 26° with respect to a longitudinal axis of said blade.

7. The improved rotor blade as set forth in claim 1 wherein said recess has an outer wall, and wherein said member engages said outer wall substantially in line contact when said rotor is caused to rotate at or greater than said sufficient angular speed.

8. The improved rotor blade as set forth in claim 1 wherein said member engages said adjacent blade opposing surface substantially in line contact when said rotor disk is caused to rotate at or greater than said sufficient angular speed.

9. The improved rotor blade as set forth in claim 1 wherein said member is adapted to substantially seal the space between said improved blade first surface and said adjacent blade opposing surface when said rotor disk is caused to rotate at said sufficient angular speed.

10. The improved rotor blade as set forth in claim 1 wherein said improved blade first surface is a leading surface of said platform portion.

11. The improved rotor blade as set forth in claim 1 wherein said rotor disk has an axis, and wherein each of said improved blade first surface and said adjacent blade opposing surface is arranged in a substantially radial plane.

12. An improved rotor blade adapted to be mounted on a rotor disk in circumferentially spaced relation to an adjacent blade, said improved blade comprising:

an airfoil portion, a platform portion and a root portion, said platform portion having a first surface adapted to be arrange din spaced facing relation to an opposing surface of said adjacent rotor blade, said blade also having an arcuate surface extending between said root portion and said first surface, said arcuate surface being bowed in a transverse direction;

two transversely spaced inclined recess slots extending into said platform portion from said first surface and toward said root portion; and said slots being configured for receiving the marginal end portions of a U-shaped member for sliding movement relative thereto, said slots being configured so that the portion of said member between said end portions may move toward and away from said arcuate bowed surface, said U-shaped member being adapted to be moved relative to said platform portion to a position at which no portion thereof extends outwardly beyond said first surface toward said opposing surface, said member being so configured and arranged that when said rotor is caused to rotate at a sufficient angular speed, the centrifugal force acting on said member will urge said member to move outwardly along a path defined by said slots to engage said adjacent blade opposing surface to damp vibrations of at least one of said blades.

13. A rotor assembly, comprising:

a rotor disk adapted to be rotated about an axis;

a plurality of blades mounted don said disk in circumferentially spaced relation for rotation therewith, each of said blades having an airfoil portion, a platform portion and a root portion, the platform portion of at least one of said blades having a first surface arranged in spaced facing relation to an opposing surface of an adjacent blade, each of said blades having said first surface also having an arcuate surface extending between said root portion and said first surface, said arcuate surface being bowed in a transverse direction;

two transversely spaced inclined recess slots extending into said platform portion of each associated blade from said first surface thereof and extending toward said root portion thereof; and a U-shaped damping member having a rod-like central portion and in-turned marginal end portions, said end portions being movably mounted in said slots so that said central portion may move toward and away from said bowed arcuate surface along the path defined by said slots, said U-shaped portion being adapted to be moved relative to said platform portion to a position at which no portion thereof extends outwardly beyond said first surface toward said opposing surface, said damping member and slots being cooperatively configured and arranged with respect to said adjacent blade opposing surface so that when said assembly is rotated at a sufficient angular speed, said damping member will move outwardly along said path so that said central portion will engage said adjacent blade opposing surface to damp vibrations of at least one of said blades.

14. The rotor assembly as set forth in claim 13 wherein said damping member is operatively arranged to seal the space between said one blade first surface and said adjacent blade opposing surface when said rotor disk is rotated at said sufficient angular speed.

15. The rotor assembly as set forth in claim 13 wherein said damping member is U-shaped and has its in-turned marginal end portions facing into said recess.

16. The rotor assembly as set forth in claim 15 wherein said damping member has a rod-like portion intermediate said in-turned marginal end portions, which intermediate portion is adapted to engage said adjacent blade opposing surface when said rotor disk is rotated at said sufficient angular speed.

17. The rotor assembly as set forth in claim 15 wherein said U-shaped damping member is formed of a length of wire.

18. The rotor assembly as set forth in claim 17 wherein the diameter of said wire is greater than the spacing between said one blade first surface and said adjacent blade opposing surface.

19. The rotor assembly as set forth in claim 13 wherein the length of said rod-like central portion is substantially equal to an overlapped length of said one blade first surface and said adjacent blade opposing surface.

20. The rotor assembly as set forth in claim 13 wherein said first surface is a leading surface of said one blade platform portion and said opposing surface is a trailing surface of said adjacent blade platform portion.

* * * * *